US008410411B2

(12) United States Patent
Song et al.

(10) Patent No.: US 8,410,411 B2
(45) Date of Patent: Apr. 2, 2013

(54) MICROWAVE OVEN INCLUDING HOOD

(75) Inventors: Sung Bae Song, Seoul (KR); Young Gyu Jung, Seoul (KR); Won Tae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 451 days.

(21) Appl. No.: 12/703,569

(22) Filed: Feb. 10, 2010

(65) Prior Publication Data

US 2010/0200576 A1 Aug. 12, 2010

(30) Foreign Application Priority Data

Feb. 11, 2009 (KR) ..... 10-2009-0010993

(51) Int. Cl.
*H05B 6/64* (2006.01)

(52) U.S. Cl. ..... 219/757; 219/756

(58) Field of Classification Search ..... 219/757, 219/756
See application file for complete search history.

(56) References Cited

U.S. PATENT DOCUMENTS 6,717,123 B1 * 4/2004 Kim ..... 219/757

FOREIGN PATENT DOCUMENTS

CN 1459589 A 12/2003

* cited by examiner

*Primary Examiner* — Matthew Reames
(74) *Attorney, Agent, or Firm* — McKenna Long & Aldridge LLP

(57) ABSTRACT

A microwave oven including a hood. The hood adapted to be withdrawn from or inserted into a hood casing. The microwave oven further including an elastic member that applies an elastic force on the hood to facilitate the withdrawal of the hood from the hood casing. The insertion of or withdrawal of the hood from the hood casing provides for a more efficient hood function.

14 Claims, 12 Drawing Sheets

MICROWAVE OVEN INCLUDING HOOD

The present application claims the benefit of priority under 35 U.S.C. 119 and 35 U.S.C. 365 to Korean Patent Application No. 10-2009-0010993 (filed on Feb. 11, 2009), which is hereby incorporated by reference for all purposes as if fully set forth in its entirety.

BACKGROUND OF THE INVENTION

1. Field of the Invention

The present disclosure relates to a microwave oven. More particularly, the present disclosure relates to a microwave oven including a slideable hood.

2. Discussion of the Related Art

A microwave oven is a cooking appliance that employs microwave radiation to heat food. Such a microwave oven may include a hood that discharges contaminated air generated while cooking food. More particularly, the hood evacuates contaminated air that is generated while cooking food and it is disposed on the lower side of the microwave oven. Furthermore, the hood discharges the suctioned air that includes contaminants to an outdoor space, or purifies the air prior to discharging the air to an indoor space.

SUMMARY OF THE INVENTION

The embodiments described herein provide a microwave oven including a hood. The hood is configured to more efficiently perform the aforementioned and other hood functions.

In one exemplary embodiment, the aforementioned and other functions are more efficiently achieved by a microwave oven having a hood function for discharging contaminated air that are generated while cooking food at a cooking device disposed on a lower side of the microwave oven, the microwave oven comprising: a cavity including a cooking chamber; a high frequency heat source providing microwaves for cooking food in the cooking chamber; a hood casing at a lower portion of the cavity, the hood casing including an intake port through which contaminated air is sucked; a drawable hood in the hood casing, the hood including an intake port through which contaminated air is sucked; an elastic member applying an elastic force to the hood to draw the hood from the hood casing; a locking member preventing the hood from being unintentionally drawn from the hood casing; and a fan providing a driving force that sucks contaminated air through the intake port of the hood casing and the intake port of the hood, or through the intake port of the hood casing when the hood is drawn from or inserted in the hood casing.

In another exemplary embodiment, the aforementioned and other functions are more efficiently achieved by a microwave oven having a hood function for discharging contaminated air that are generated while cooking food at a cooking device disposed on a lower side of the microwave oven, the microwave oven comprising: a cavity including a cooking chamber; a high frequency heat source providing microwaves for cooking food in the cooking chamber; a guide casing at a lower portion of the cavity, the guide casing including an intake port through which contaminated air is sucked; a drawable guide member in the guide casing, the guide member guiding contaminated air to the intake port, a rear end of the guide member being spaced apart horizontally from the intake port when inserted in the guide casing; an elastic member applying an elastic force to the guide member to draw the guide member from the guide casing; a locking member preventing the guide member from being unintentionally drawn from the guide casing; a rail assembly that guides the inserting and drawing of the guide member into and from the guide casing; and a fan providing a driving force that sucks contaminated air through the intake port when the guide member is drawn from or inserted in the guide casing.

In further another exemplary embodiment, the aforementioned and other functions are more efficiently achieved by a microwave oven having a hood function for discharging contaminated air generated while cooking food at a cooking device disposed below the microwave oven, the microwave oven comprising: a cavity including a cooking chamber; a high frequency heat source providing microwaves for cooking food in the cooking chamber; a casing at a lower portion of the cavity, the casing including an intake port through which contaminated air is sucked; a drawable moving member in the casing; a fan providing a driving force that sucks contaminated air through the intake port of the casing when the moving member is drawn from or inserted in the casing; and an illumination source at the moving member, the illumination source providing light for illuminating the cooking device.

The foregoing and other features, aspects, and advantages of the present invention will become more apparent from the following detailed description of the present invention when taken in conjunction with the accompanying drawings.

DETAILED DESCRIPTION OF THE ILLUSTRATED EMBODIMENTS

Figure 1:
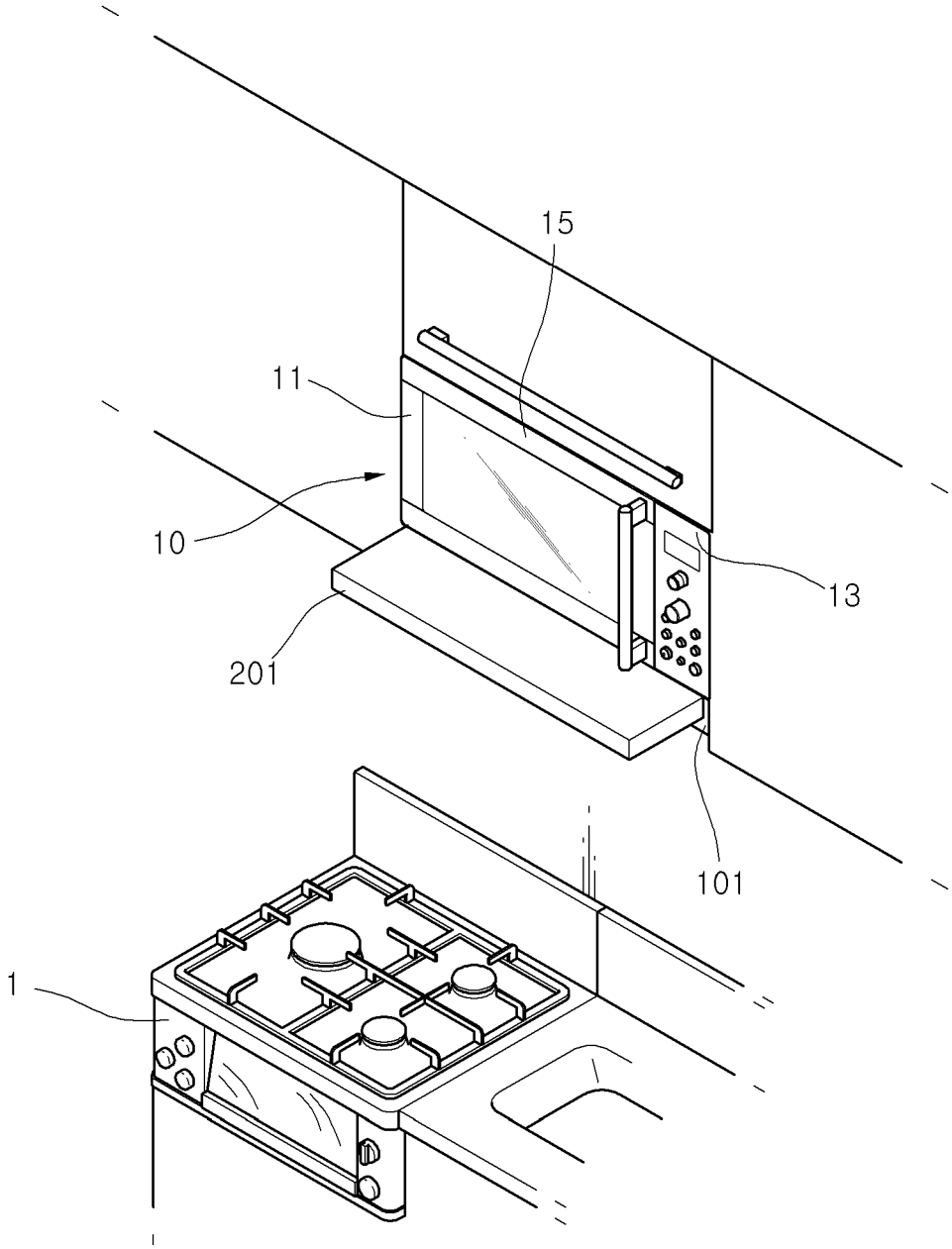
FIG. 1 is a perspective view illustrating a microwave oven including a hood, according to an embodiment.
Figure 2:
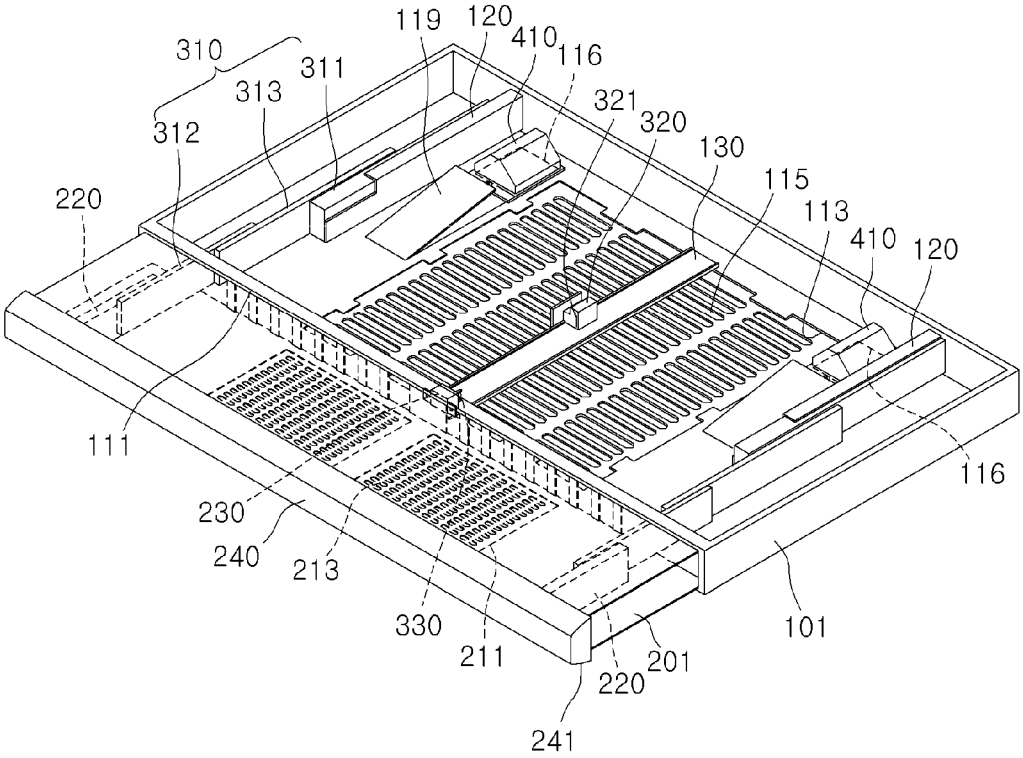
FIG. 2 is a perspective view illustrating various details associated with the microwave oven of FIG. 1.
Figure 3:
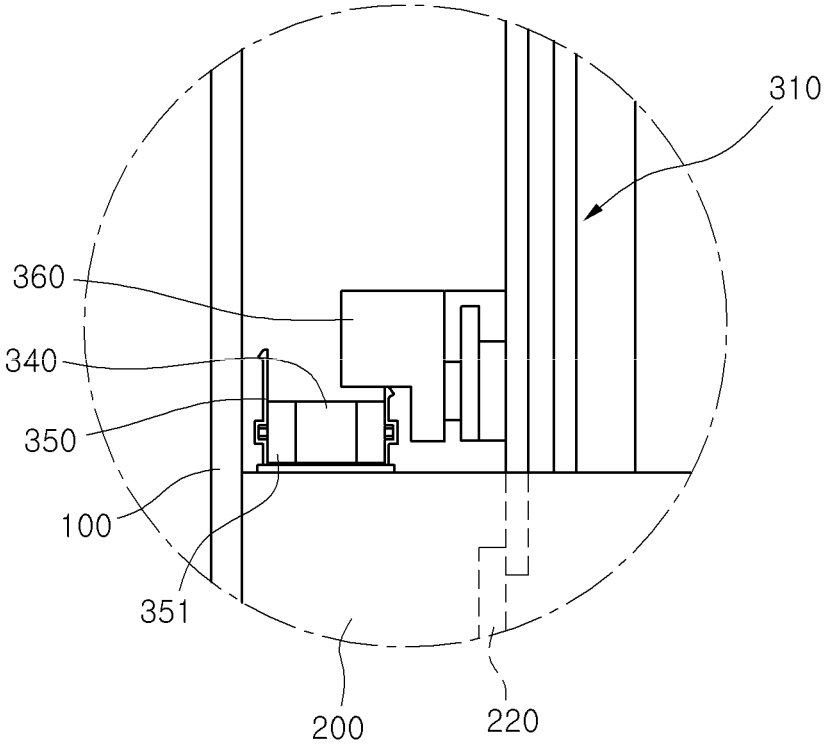
FIG. 3 is a plan view illustrating additional details associated with the microwave oven of FIG. 1.

Reference will now be made in detail to a number of embodiments. Examples of the exemplary embodiments are illustrated in the accompanying drawings. FIG. 1 is a perspective view illustrating a microwave oven 10 including a hood 201, according to the exemplary embodiments. FIG. 2 is a perspective view illustrating various details associated with the microwave oven 10. FIG. 3 is a plan view illustrating additional details associated with the microwave oven 10.

Referring to FIG. 1, a cooking device 1 is generally located in a kitchen. The cooking device 1 includes a gas range generally provided above an oven or on a kitchen counter, for heating food using gas. It is noted that that the cooking device 1 is not limited to a gas-type device and may be an alternative type cooking device. For example, the cooking device 1 may alternatively heat food using electricity.

The microwave oven 10, including the hood 201, may be disposed above cooking device 1, as illustrated in FIG. 1. The microwave oven 10 heats food using microwaves and/or heat, and it has an air evacuation function in which contaminated air generated while cooking food using cooking device 1 may be discharged to an outdoor space or purified and circulated back to an indoor space. Because the cooking function of the microwave oven 10, and various parts associated with the cooking function are well known, a detailed description thereof will be omitted.

The microwave oven 10 is provided with a cavity (not shown) that serves as a cooking chamber. The microwave oven 10 includes a door 11 for selectively opening and closing the cooking chamber. The microwave 10 may further include a control panel 13 that may receive operation signals for operating the microwave oven 10 and that may display information about the operation thereof. The microwave oven 10 may include a heat source for cooking food in the cooking chamber, e.g. a high-frequency heat source and/or a radiation heat source and/or a convection heat source.

A passageway to facilitate the air evacuation function may be disposed in the microwave oven 10. More particularly, the microwave oven 10 may include an outdoor discharge passageway (not shown) and/or an indoor discharge passage (not shown) therein. The outdoor discharge passageway discharges contaminated air originating from an indoor space to an outdoor space. The contaminated air is introduced through a main intake port 113 (described below), or through both the main intake port 113 and an auxiliary intake port 211 (described below) and discharged to an outdoor space. The indoor discharge passageway may purify the air so that it may be circulated back to the indoor space. A filter (not shown) for removing contaminants from the air may be disposed at or in the indoor discharge passageway. The outdoor discharge passage, the indoor discharge passage, and the filter are generally known in the microwave oven arts to include a hood, thus, a description thereof will be omitted.

The front upper end of the microwave oven 10 is provided with a discharge grill 15. The general location of the discharge grill 15 is illustrated in FIG. 1. The contaminated air flows into the indoor discharge passage and is purified by the filter. It is then discharged back into the indoor space via the discharge grill 15.

A vent fan (not shown) may be disposed in the microwave oven 10. The vent fan draws air through the main intake port 113 or both the main intake port 113 and the auxiliary intake port 211, and causes the air to flow into the outdoor discharge passageway or the indoor discharge passageway, so the air may be discharged to an indoor or outdoor space.

The lower portion of the microwave oven 10 may be provided with a hood casing 101 and hood 201 to facilitate the air evacuation function. The hood casing 101 may be fixed to a bottom portion of the microwave oven 10. The hood 201 may be slidably received within the hood casing 101 such that it is capable of back-and-forth movement in a direction toward and away from the microwave oven 10.

More particularly, with reference to FIGS. 2 and 3, the hood casing 101 may have a substantially slim hexahedron shape with an open upper surface. The hood casing 101 and the microwave oven 10 may have the same horizontal dimensions, such that the hood casing 101 substantially defines both partial side surfaces and the bottom appearance of the microwave oven 10.

The front surface of the hood casing 101 may be provided with a drawer opening 111. The drawer opening 111 may function as an inlet through which the hood 201 may be inserted and removed. The drawer opening 111 may be formed by partially cutting the front surface of the hood casing 101. Other methods known in the art may also be utilized to form the drawer opening 111.

The bottom portion of the hood casing 101 may be provided with the main intake port 113 that functions as an inlet through which contaminated air, generated while cooking food using cooking device 1, is drawn. The main intake port 113 may be formed by partially cutting out a bottom surface of the hood casing 101. When the hood casing 101 is provided at the portion of the microwave oven 10, the main intake port 113 may communicate with the outdoor discharge passageway and the indoor discharge passageway.

A main filter 115 is disposed on the main intake port 113 to remove contaminants from the air drawn in through the main intake port 113. In addition, illumination openings 116 may be provided at the bottom surface of the hood casing 101 on both sides of the main intake port 113, respectively.

Figure 6:
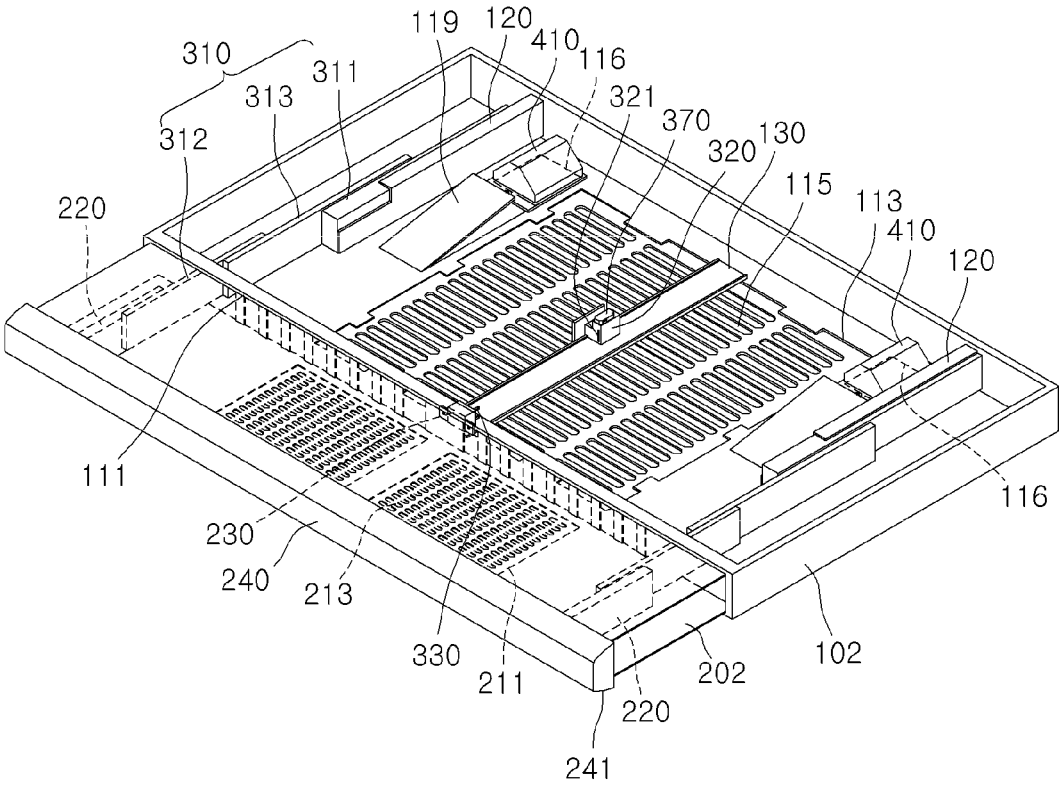
FIG. 6 is a perspective view illustrating a principal part of a microwave oven including a hood, according to another embodiment.

Still further, air barriers 119 may be provided at the bottom surface of the hood casing 101 just in front of the illumination openings 116. The air barriers 119 prevent contaminated air flowing in the hood casing 101 from coming in contact with lamp assemblies (discussed below). In the present embodiment, each of the air barriers 119 extend upward at a predetermined angle towards the rear of the hood casing 101, as illustrated in FIG. 6.

Two first guide bars 120 may be disposed in the hood casing 101. The first guide bars 120 are used to fix a first rail 311 (discussed below). The first guide bars 120 also guide contaminated air, drawn through the main intake port 113 and the auxiliary intake port 211, towards the rear of the hood casing 101 such that the air may flow to the outdoor discharge passageway and/or the indoor discharge passageway.

When the hood 201 is inserted into the hood casing 101, the front ends of the first guide bars 120 are adjacent to the rear end of the hood 201, while the rear ends of the first guide bars 120 are in close contact with the rear surface of the hood casing 101. The upper ends of the first guide bars 120 may be in close contact with the bottom surface of the cavity when the hood casing 101 is provided at the lower portion of the microwave oven 10.

An installation bracket 130 may be disposed in the hood casing 101. The installation bracket 130 is used to install a latch module 320 (described below). The installation bracket 130 may be disposed along a center line that laterally bisects the hood casing 101. Thus, the installation bracket 130 substantially crosses the main intake port 113, but does not interfere with the insertion and removal of the hood 201. To this end, the installation bracket 130 may be disposed on the lower side of the hood 201 when the hood 201 is retracted or inserted, i.e. installed in, the hood casing 101. Alternatively, the front end of the installation bracket 130 may be spaced rearward from the rear end of the hood 201 when the hood 201 is retracted.

The hood 201 may have a slim hexahedron shape, as stated above, and as suggested in FIG. 1, with an open rear surface and with a vertical section approximately corresponding to the drawer opening 111. Thus, the hood 201 is capable of sliding back-and-forth through the drawer opening 111 of hood casing 101 in a either a direction toward or away from the microwave oven 10.

The bottom surface of the hood 201 is provided with the auxiliary intake port 211. The auxiliary intake port 211 functions as an inlet when the hood 201 is drawn out of the hood casing 101, for evacuating contaminated air generated while cooking food using the cooking device 1. The auxiliary intake port 211 may be formed by apertures through the bottom surface of the hood 201, such as by cutting out a portions of the bottom surface of the hood 201. However, other methods known in the art may be utilized to form the auxiliary intake port 211. Thus, the auxiliary intake port 211 may be disposed in front of the main intake port 113 when the hood 201 is inserted into the hood casing 101.

When the hood 201 is inserted in the hood casing 101, i.e. slid back into drawer opening 111, the rear end of the hood 201 is disposed at the rear side of the main intake port 113, and the auxiliary intake port 211 vertically overlaps the main intake port 113. In other words, when the hood 201 is inserted, the main intake port 113 and the auxiliary intake port 211 vertically and completely overlap each other. This prevents contaminated air drawn through the main intake port 113 from interfering with the hood 201 when the hood 201 is inserted in the hood casing 101.

Alternatively, when the rear ends of the upper and lower surfaces of the hood 201 do not overlap the main intake port 113 when the hood 201 is inserted in the hood casing 101, the same effect as described above can be obtained. In other words, contaminated air drawn through the main intake port 113 flows in the hood 201 through the auxiliary intake port 211, thus preventing the air sucked through the main intake port 113 from interfering with the hood 201.

An auxiliary filter 213 is disposed at the auxiliary intake port 211. It removes contaminants from air drawn through the auxiliary intake port 211, similar to the function of main filter 115.

The hood 201 is provided with two second guide bars 220 as illustrated in FIGS. 2 and 4-12. The second guide bars 220 guide contaminated air, drawn through the auxiliary intake port 211 when the hood 201 is removed from the hood casing 101. Second rails 312, described below, are fixed to the second guide bars 220. The second guide bars 220 may have a bar shape with a longitudinal section that corresponds in size and shape to the inner space of the hood 201. Second guide bars 220 further may have a predetermined length corresponding to the extent of the back-and-forth movement of the hood 201.

One side surface of the second guide bars 220 faces the first guide bars 120 as illustrated in FIGS. 2 and 4-12. More particularly, each of the second guide bars 220 is disposed between a side surface of the hood casing 101 and the first guide bar 120. The length of the second guide bars 220 is designed so that there is no interference when inserting the hood 201 into the hood casing 101. In other words, the length of the second guide bars 220 is at least less than the length of the hood 201 and less than the length of the hood casing 101.

The rear surface of the hood 201 is provided with an installation rib 230 that is disposed along a line laterally bisecting the rear surface of the hood 201. A latch protrusion 330, be described below, is fixed to the installation rib 230.

The front surface of the hood 201 is provided with a front panel 240 that substantially defines the front surface of the hood 201. The front panel 240 has a shape that corresponds to the front portion of the hood casing 101. The rear surface of the front panel 240 may be spaced apart from the front portion of the hood casing 101 when the hood 201 is inserted in the hood casing 101. The lower end of the front panel 240 may be provided with a sloped part 241 at a downward, at a predetermined angle as illustrated in FIG. 2. The sloped part 241 may protect a user from colliding with a corner of the front panel 240 when the hood 201 is withdrawn from the hood casing 101, and further may enable better viewing of the cooking device 1.

Two rail assemblies 310 are provided to guide the insertion and withdrawal of the hood 201 to and from the hood casing 101. Each of the rail assemblies 310 may include first, second and third rails 311, 312, and 313. The first and second rails 311 and 312 are respectively fixed to oppositely facing surfaces of the first and second guide bars 120 and 220 respectively. The third rail 313 is slidable on the first and second rails 311 and 312.

A locking device may be provided to prevent the hood 201 from being unintentionally withdrawn from the hood casing 101. The locking device may include the latch module 320 and the latch protrusion 330.

The latch module 320 may be disposed on the upper surface of the installation bracket 130. The latch module 320 may include a latch slot 321 into which the latch protrusion 330 may be inserted, and a latch hook (not shown) that selectively engages with the latch protrusion 330 once it is inserted through the latch slot 321.

The latch protrusion 330 may be provided at the rear surface of the installation rib 230. When the hood 201 is inserted in the hood casing 101, the latch protrusion 330 may be inserted through the latch slot 321 and into the latch module 320, and then engaged with the latch hook (not shown). More particularly, when an external force is applied to the withdrawn hood 201 in a direction toward the hood casing 101, the latch protrusion 330 passes through the latch slot 321 and is inserted into the latch module 320 so as to engage with the latch hook. When the external force is again applied to the hood 201, when the latch protrusion 330 is engaged with the latch hook, the latch protrusion 330 will disengage from the latch hook and withdraw from the latch slot 321. The latch module 320 will thus withdraw, allowing the hood 201 to withdraw from the hood casing 101.

Referring to FIG. 3, a spring 340 may be provided to supply an elastic force that aids in withdrawing the hood 201 from the hood casing 101 when the latch protrusion 330 is disengaged from the latch hook. A front end of the leaf spring 340 may be fixed to the hood 201 while a rear end of the spring may be attached to roller 351, which is rotatably provided on a spring holder 350. The leaf spring 340 is thus wound about a longitudinal axis of roller 351, as illustrated in FIG. 3. The spring holder 350 is provided on the hood casing 101. The length along which the leaf spring 340 is wound around the roller 351 may be greater than a distance that the hood 201 is withdrawn from the hood casing 101. Thus, when the latch protrusion 330 is disengaged from the latch hook, the leaf spring 340 has a elastic tendency to unwind from the roller 351. Thus the hood 201 may be withdrawn from the hood casing 101 due to the resulting elastic force.

The bottom surface of the hood casing 101 may be provided with two dampers 360, as illustrated in FIG. 3, that prevent the elastic force of the leaf spring 340 from withdrawing the hood 201 from the hood casing 101 at a high speed. Since the dampers 360 are well known, a description thereof will be omitted.

Lamp assemblies 410 may be disposed on the illumination openings 116, as shown in FIGS. 2 and 4-12. The lamp assemblies 410 may provide light for illuminating cooking device 1, and may be composed of halogen or light emitting diode (LED) type lighting elements. The lamp assemblies 410 may be operated, for example, by a switch on the control panel 13.

Figure 4:
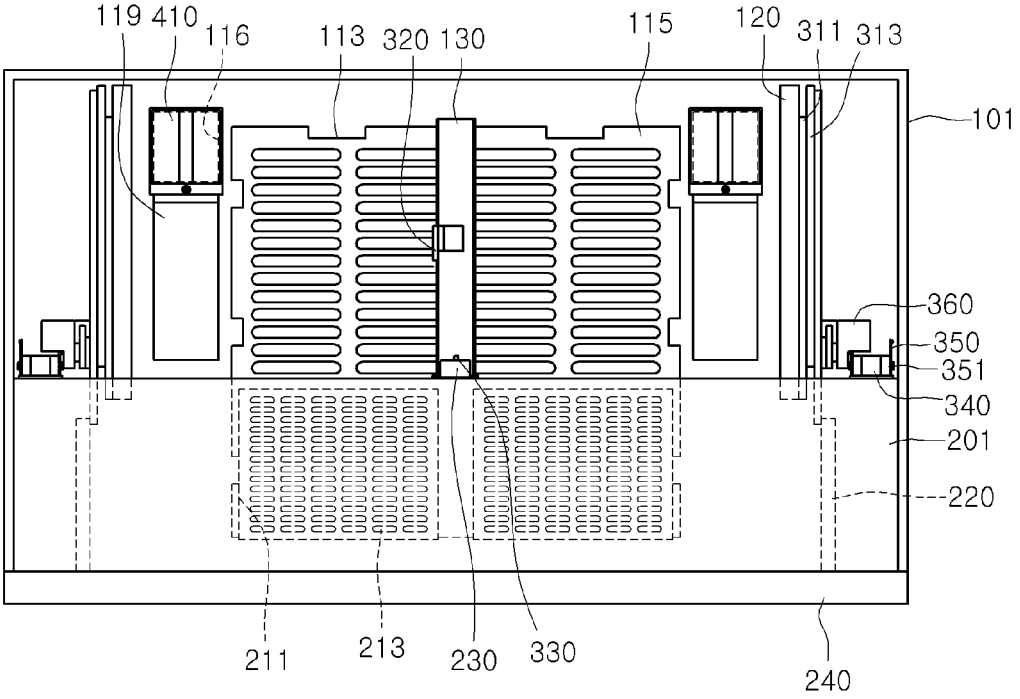
FIGS. 4 and 5 are schematic views illustrating a process where the hood of the microwave oven of FIG. 1 is inserted and drawn.
Figure 5:
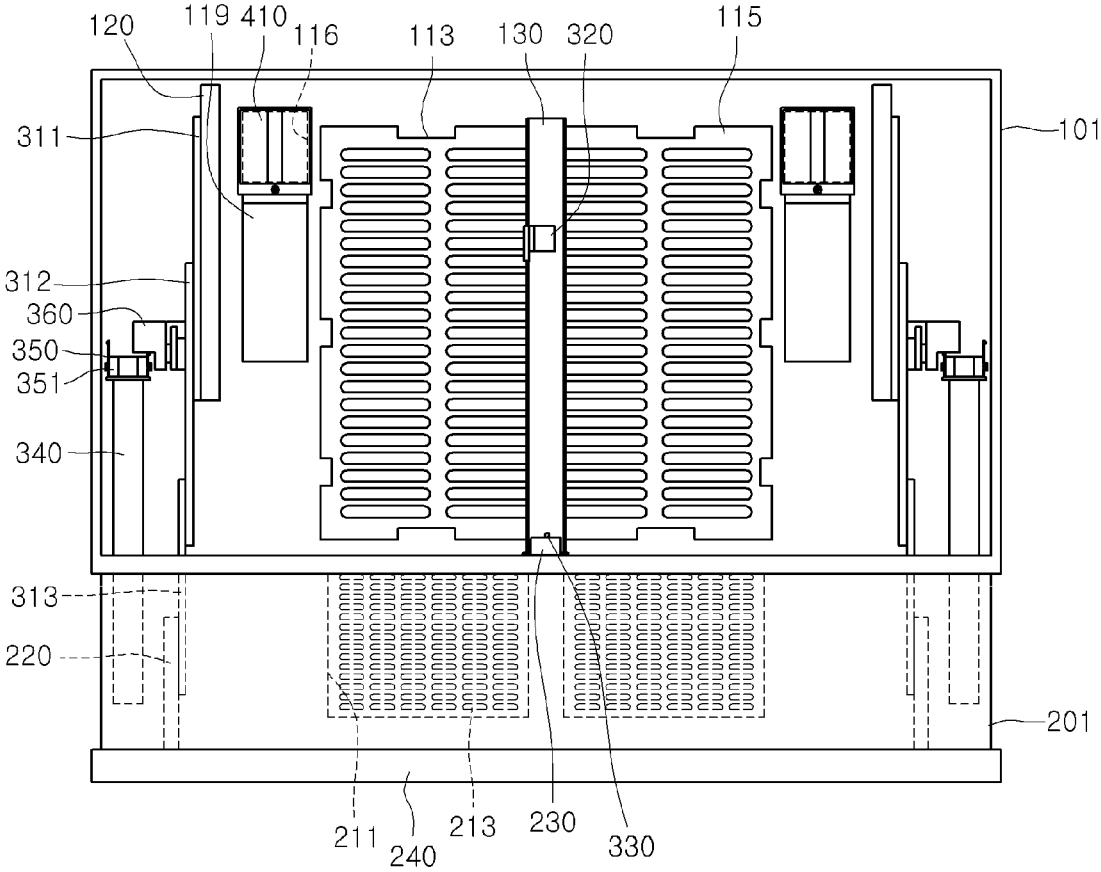

Hereinafter, the operation of the microwave oven 10 will now be described in detail with reference to the accompanying drawings. FIGS. 4 and 5 are schematic views illustrating a process where the hood 201 of the microwave oven 10 inserted in and withdrawn from the hood casing 101.

Referring to FIG. 4, when the hood 201 is inserted in the hood casing 101, the latch protrusion 330 may be inserted into the latch module 320, through latch slot 321, and engaged with the latch hook. Thus, although the elastic force of the leaf spring 340 is applied to the hood 201, the hood 201 remains in the hood casing 101.

As stated, when an external force in the direction of the hood casing 101 is applied to the hood 201, the latch protrusion 330 disengages from the latch hook and withdraws from the latch module 320 through the latch slot 321. When the latch protrusion 330 is disengaged from the latch hook, the elastic force of the leaf spring 340 acts to withdraw the hood 201 from the hood casing 101. As the hood 201 withdraws, the second rail 312 slides on the third rail 313, and the third rail 313 slides on the first rail 311, so as to guide the hood 201 as it withdraws from the hood casing 101.

Referring to FIG. 5, when the hood 201 is withdrawn completely from the hood casing 101, the vent fan is driven. The driving of the vent fan may be performed by inputting an operation signal to the control panel 13. Thus, contaminated air generated by cooking food on the cooking device 1 may be evacuated through the main intake port 113 and the auxiliary intake port 211. The contaminated air then may flow along the aforementioned outdoor discharge passageway so that it may be discharged to an outdoor space. Alternatively, the air may flow along the indoor discharge passageway and the contaminants may be removed by the filter, so that purified air may be discharged to an indoor space through discharge grill 15.

Once the hood 201 is withdrawn from the hood casing 101 and the vent fan is activated, the first and second guide bars 120 and 220 substantially guide contaminated air drawn into the hood casing 101 through the main intake port 113 and the auxiliary intake port 211, and to the rear end of the hood casing 101. Further, when the hood 201 is withdrawn from the hood casing 101, the first and second guide bars 120 and 220 and the rail assemblies 310 substantially separate the space where the leaf spring 340 is disposed and the space where contaminated air flows through the main intake port 113 and the auxiliary intake port 211 flows. Thus, the leaf spring 340 is prevented from being exposed to the contaminated air drawn into the system.

A user may also operate the air evacuation function when the hood 201 is inserted in the hood casing 101. That is, the user may turn on the vent fan 300 when the hood 201 is inserted in the hood casing 101. Because the auxiliary intake port 211 vertically overlaps the main intake port 113, contaminated air enters the system substantially through the main intake port 113.

Hereinafter, the operation of a microwave oven 10 including a hood 202 will now be described in detail with reference to FIG. 6 according to another exemplary embodiment. In both the embodiment of FIG. 6 and the previous embodiment of FIGS. 1 to 3, like reference numerals denote like elements, and thus a description thereof will be omitted.

As illustrated in FIG. 6, a switch 370 is disposed in the hood casing 102. More particularly, the switch 370 is disposed on the upper surface of the latch module 320. When the hood 202 begins to withdraw from the hood casing 102, the switch 370 is automatically turned on which generates a signal for operating the vent fan. When the hood 202 is completely inserted into the hood casing 102, the switch 370 is turned off which stops the vent fan.

Thus, according to this exemplary embodiment, the vent fan turns on or turns off automatically depending on whether the hood 202 is inserted into or withdrawn from the hood casing 102, without the user manipulating a switch on control panel 13. However, it is possible to further include a manual switch at the control panel 13, that may be used to override the signal from the switch 370, thus allowing the user to control the operation of the vent fan whether the hood 202 is inserted or withdrawn from the hood casing 102.

In one configuration, the switch 370 may be activated and deactivated, for example, by the installation rib 230. Alternatively, the switch 370 may be activated and deactivated by a discrete member disposed on one side of the install rib 230.

Figure 7:
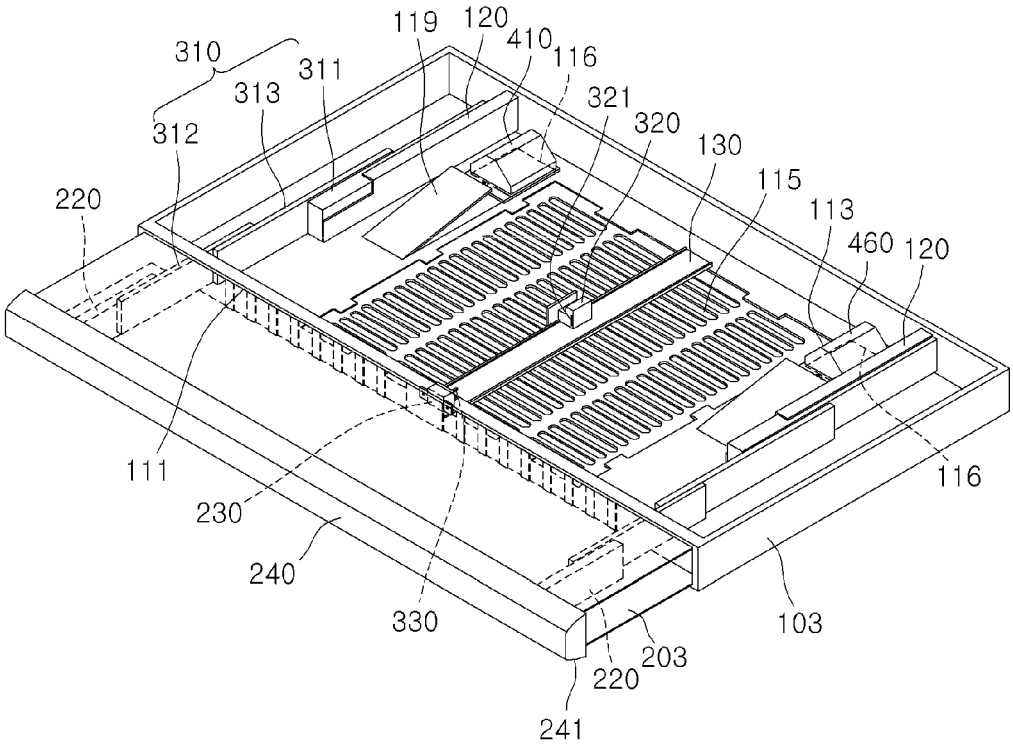
FIG. 7 is a perspective view illustrating a principal part of a microwave oven including a guide member, according to another embodiment.

Hereinafter, the operation of microwave oven 10 including a guide member 203 will now be described in detail with reference to FIG. 7 in accordance with another exemplary embodiment. In the embodiment of FIG. 7 and the previous embodiment of FIGS. 1 to 3, like reference numerals denote like elements, and thus a description thereof will be omitted.

As illustrated in FIG. 7, a guide casing 103 and the guide member 203 may be provided, which replace the hood casing and the hood, respectively, of the previous embodiments. The guide casing 103 has the substantially same configuration as the hood casing 101. The guide member 203 has substantially the same configuration as the hood 201, except that the auxiliary intake port 211 is not employed, and that the rear surface is closed. The rear end of the guide member 203 may be disposed in front of the main intake port 113 when the guide member 203 is inserted into the guide casing 103. Thus, contaminated air can be drawn through the main intake port 113 even when the guide member 203 is inserted in the guide casing 103. The guide member 203 is capable of sliding back-and-forth in an direction towards and away from the microwave oven, allowing for the guide member 203 to be inserted into and withdrawn from the guide casing 103. The structural components for achieving this may be the same as described above and as illustrated in FIGS. 2 to 3.

In the present embodiment, the guide member 203 substantially guides contaminated air, generated by the cooking of food on the cooking device 1, to the main intake port 113, so as to prevent diffusion of contaminated air through out the indoor space.

In this embodiment, the vent fan may be automatically or manually turned on or off when the guide member 203 is withdrawn from the guide casing 103 as described in the previous embodiments. That is, when the vent fan is driven as the guide member 203 is withdrawn from the guide casing 103, the guide member 203 prevents diffusion of contaminated air, and the contaminated air may be drawn through the main intake port 113. However, when the vent fan is not driven as the guide member 203 is withdrawn from the guide casing 103, the guide member 203 may act to just prevent further diffusion of the contaminated air.

Figure 8:
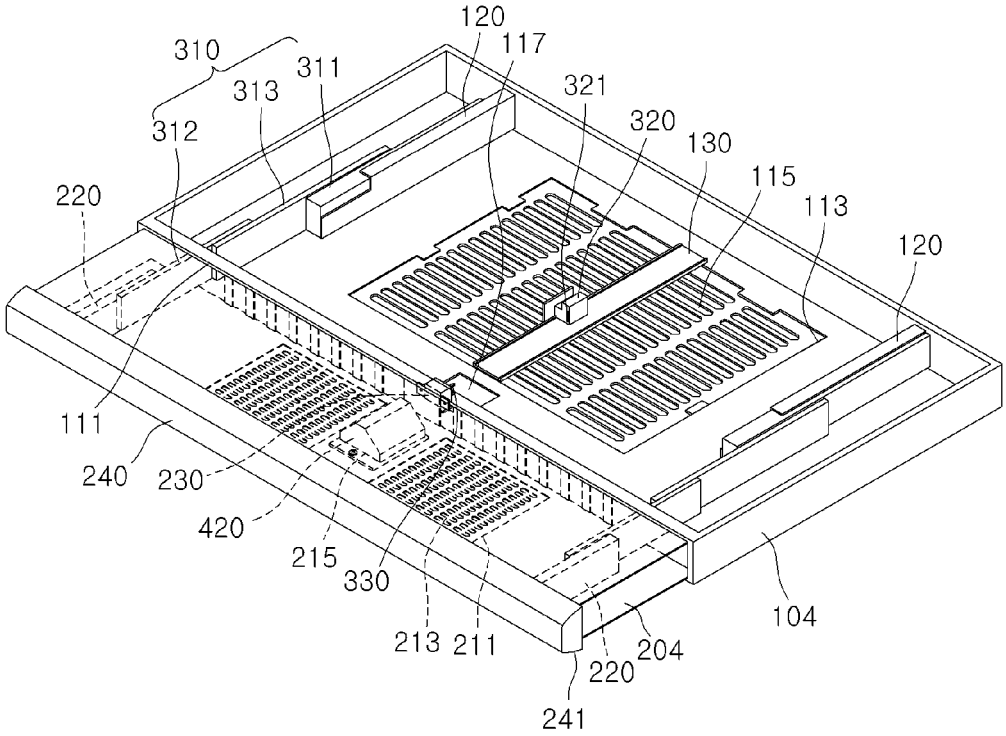
FIG. 8 is a perspective view illustrating a principal part of a microwave oven including a hood, according to another embodiment.

The operation of a microwave oven 10 including a hood 204 will now be described in detail in accordance with another exemplary embodiment. FIG. 8 is a perspective view illustrating a principal part of microwave oven 10 according to this embodiment. In the embodiment of FIG. 8 and the previous embodiments of FIGS. 1 to 5, like reference numerals denote like elements, and thus a description thereof will be omitted.

As illustrated in FIG. 8, the bottom front end of a hood casing 104 may be provided with a pass opening 117 that may be formed by cutting out a portion of the bottom surface of the hood casing 104. Light from lamp assembly 420 (described below) may pass downward through the pass opening 117 to illuminate the cooking device 1 (refer to FIG. 1).

The bottom surface of the hood 204 may also be provided with an illumination opening 215 that corresponds to and vertically overlaps with the illumination opening 117 when the hood 204 is inserted into the hood casing 104. The lamp assembly 420 may be disposed on the illumination opening 215 to illuminate the cooking device 1.

Although not shown, a cover glass may be disposed on the illumination opening 215. The cover glass prevents the lamp assembly 420 from being exposed to contaminates through the illumination opening 215.

In the hood casing 104 and the hood 204, the structural components for evacuating contaminated air and for inserting and withdrawing the hood 204 are the same as those described above in the embodiment of FIGS. 1 to 5.

Figure 9:
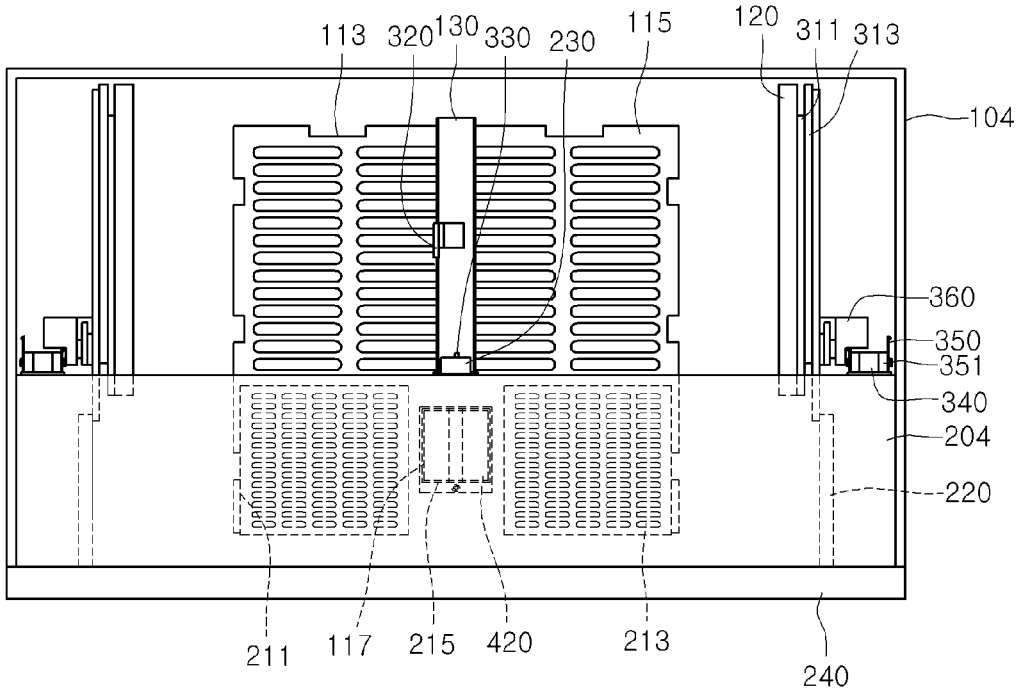
FIGS. 9 and 10 are schematic views illustrating a process where the hood of the microwave oven of FIG. 8 is drawn and inserted.
Figure 10:
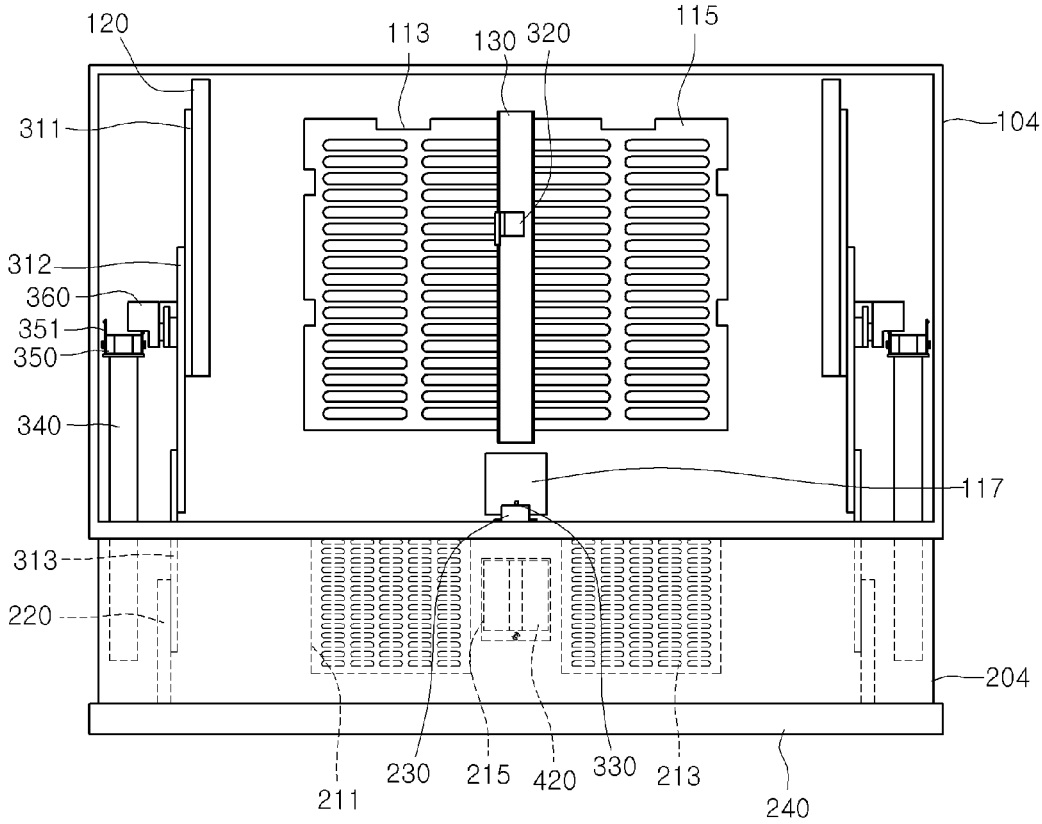

The operation of the microwave oven 10 including the hood 204 will now be described in detail with reference to the accompanying drawings according to the embodiment described above and illustrated in FIG. 8. FIGS. 9 and 10 are schematic views illustrating the process of inserting and withdrawing the hood 204 according to this embodiment.

As illustrated in FIG. 9, when the hood 204 is inserted into the hood casing 104, the lamp assembly 420, the illumination opening 215, and the pass opening 117 overlap vertically and align with each other. When the lamp assembly 420 is turned on, for example, by manipulating a switch on control panel 13 (FIG. 1), light from the lamp assembly 420 travels downward through the illumination opening 215 and the pass opening 117. Thus, the cooking device 1 (refer to FIG. 1) may be illuminated by the lamp assembly 420.

As illustrated in FIG. 10, the hood 204 may be withdrawn from the hood casing 104. Because the process of withdrawing the hood 204 from the hood casing 104 is the same as the previous embodiment described above and illustrated in FIGS. 1 to 5, a detailed description thereof will be omitted. When the hood 204 is withdrawn from the hood casing 104, the lamp assembly 420 is also withdrawn from the hood casing 104.

When the hood 204 is withdrawn from the hood casing 104 and the lamp assembly 420 is turned on, light transmits downward through illumination opening 215. Thus, the lamp assembly 420 illuminates the cooking device 1.

Figure 11:
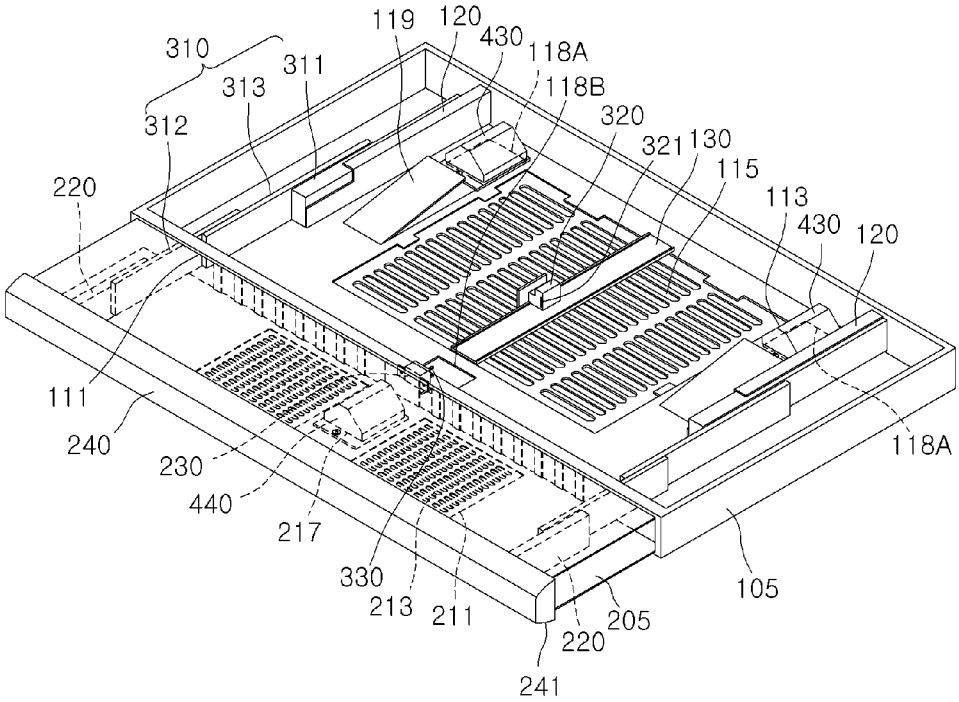
FIG. 11 is a perspective view illustrating a principal part of a microwave oven including a hood, according to another embodiment.

The operation of microwave oven 10 including a hood 205 will now be described in detail with reference to FIG. 11 in accordance with another exemplary embodiment. In the embodiment of FIG. 11 and the previous embodiment described above and illustrated in FIGS. 1 to 5, like reference numerals denote like elements, and thus a description thereof will be omitted.

Referring to FIG. 11, main illumination openings 118A may be disposed on both side ends of the bottom surface of a hood casing 105, respectively. The front end of the bottom surface of the hood casing 105 may provided with a pass opening 118B. The main illumination openings 118A and the pass opening 118B may be formed by partially cutting the bottom surface of the hood casing 105.

Main lamp assemblies 430 may be disposed on each of the main illumination openings 118A, respectively. The main lamp assemblies 430 may illuminate the cooking device 1 (refer to FIG. 1).

The bottom surface of the hood 205 may provided with an auxiliary illumination opening 217 that vertically overlaps the pass opening 118B when the hood 205 is inserted into the hood casing 105. An auxiliary lamp assembly 440 may be disposed on the auxiliary illumination opening 217. The auxiliary lamp assembly 440 may also illuminate the cooking device 1.

Cover glass (not shown) may be disposed on the main illumination openings 118A and the auxiliary illumination opening 217, respectively. The cover glass would prevent the main lamp assemblies 430 and the auxiliary lamp assembly 440 from being exposed to contaminates through the main illumination openings 118A or the auxiliary illumination opening 217.

In the hood casing 105 and the hood 205, the structural components for evacuating contaminated air and for inserting and withdrawing the hood 205 may be the same as those of the embodiment described above and illustrated in FIGS. 1 to 5. Therefore, a description of these components will not be repeated here.

The main lamp assemblies 430 and the auxiliary lamp assembly 440 may be turned on by manipulating a switch on the control panel 13 (refer to FIG. 1), regardless whether the hood 205 is withdrawn from or inserted into the hood casing 105. Thus, when the hood 205 is inserted into the hood casing 105, light generated by the main lamp assemblies 430 may transmit downward through the main illumination openings 118A, and light generated by the auxiliary lamp assembly 440 may transmit downward through the auxiliary illumination opening 217 and the pass opening 118B. Alternatively, when the hood 205 is withdrawn from the hood casing 105, light from the main lamp assemblies 430 travels downward through the main illumination openings 118A, and light of the auxiliary lamp assembly 440 travels downward only through the auxiliary illumination opening 217.

The main lamp assemblies 430 may be turned on by manipulating a switch, as stated, such as illumination button 249 (See FIG. 2), regardless whether the hood 205 is withdrawn from or inserted into the hood casing 105. Further, the auxiliary lamp assembly 440 may be turned on by manipulating a switch on the control panel 13. When the hood 205 is inserted into the hood casing 105, light from the main lamp assemblies 430 travels downward through the main illumination openings 118A. When the hood 205 is withdrawn from the hood casing 105, light of the main lamp assemblies 430 still travels through the main illumination openings 118A, however light from the auxiliary lamp assembly 440 travels downward only through the auxiliary illumination opening 217. If the auxiliary lamp assembly 440 is only operational when the hood 205 is withdrawn, the pass opening 118B may be omitted.

Figure 12:
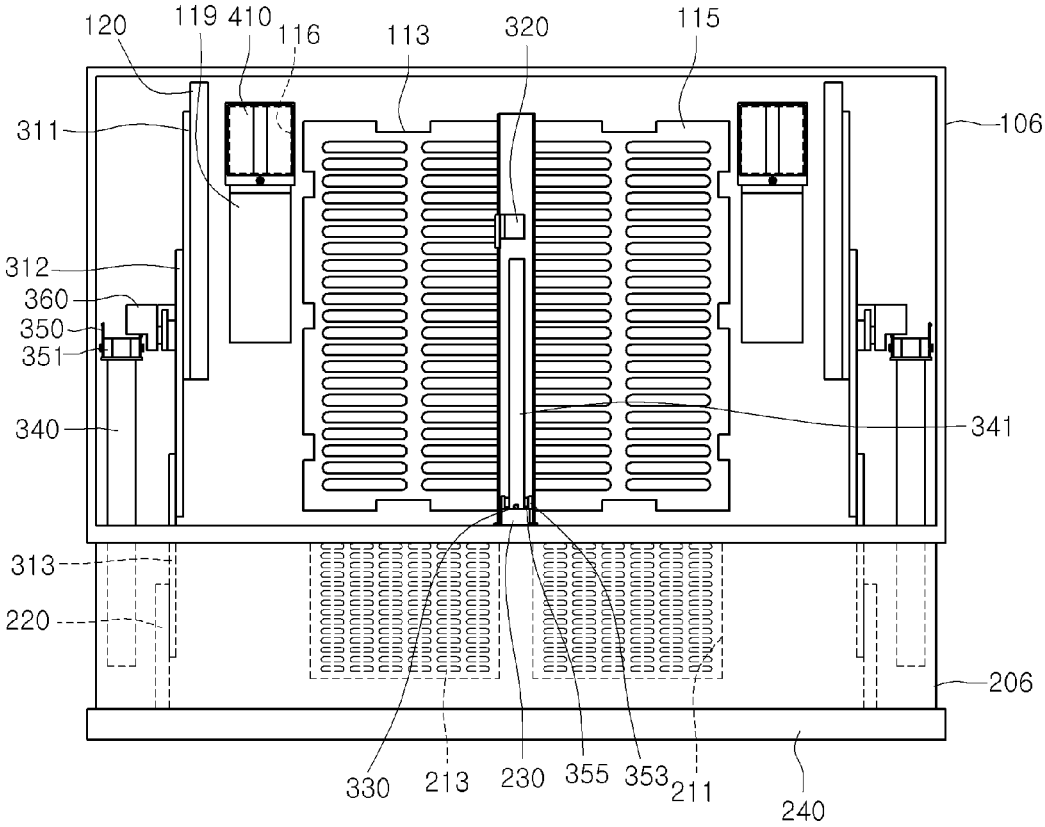
FIG. 12 is a perspective view illustrating a principal part of a microwave oven including a hood, according to another embodiment.

Hereinafter, the operation of microwave oven 10 including a hood 206 will now be described in detail with reference to FIG. 12 in accordance with another exemplary embodiment. In the embodiment of FIG. 12 and the previous embodiment described above and illustrated in FIGS. 1 to 5, like reference numerals denote like elements, and thus a description thereof will be omitted.

As illustrated in FIG. 12, a leaf spring 341 provides an elastic force on the hood 206 in a direction away from the microwave oven, i.e. in a direction where the hood 206 is being withdrawn from hood casing 106. One end of the leaf spring 341 may fixed to one side of the installation bracket 130. Thus, the leaf spring 341 may be disposed substantially on a line that laterally bisects the hood casing 106. The rear surface of the hood 206 may be provided with a spring holder 353. The leaf spring 341 is wound about a roller 355, which is coupled to the spring holder 353 in a manner to allow rotation.

In the embodiment of FIGS. 8 to 10 and the embodiment of FIG. 11, the lamp assembly and/or the auxiliary lamp assembly may be provided to the hood that is inserted into and withdrawn from the hood casing. However, the lamp assembly and/or the auxiliary lamp assembly may also be provided to the guide member that is inserted into and withdrawn from the guide casing of the embodiment associated with FIG. 7.

The microwave oven including a hood according to the above-identified exemplary embodiments has the following effects. Because the hood may be inserted into and withdrawn back-and-forth in a direction toward and away from the microwave oven, the area capable of evacuating contaminated air is substantially increased, or diffusion of contaminated air is substantially prevented. Thus, a user can cook food in a cleaner environment.

In addition, when the hood is inserted into the hood casing, the intake port of the hood casing does not substantially overlap the intake port of the hood in the direction in which contaminated air flows. Thus, depending on the amount of contaminated air, the air evacuation function may be performed in the state where the hood is inserted into the hood casing or in the state where the hood is withdrawn from the hood casing, thus effectively increasing the evacuation capabilities of the device.

In addition, various elements for inserting the hood are disposed in the hood casing. Thus, because only the hood is inserted into or drawn from the hood casing with the elements fixed, the microwave oven may be prevented from being damaged while inserting and drawing the hood.

In addition, the inner spaces of the hood casing and the hood may be divided into the region where contaminated air flows and the region in which the elements for inserting and drawing the hood are disposed. This prevents contaminated air from contaminating or damaging the elements.

In addition, a driving force for inserting and drawing the hood is transmitted to both the side ends of the hood. Thus, the hood is drawn and inserted at a uniform speed, as a whole, thus improving reliability during the withdrawal and insertion of the hood.

Although the embodiments have been described with reference to a number of illustrative embodiments thereof, it should be understood that numerous other modifications and embodiments can be devised by those skilled in the art that will fall within the spirit and scope of the principles of this disclosure. More particularly, variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A microwave oven capable of discharging contaminated air generated by cooking food using a cooking device disposed below the microwave oven, the microwave oven comprising:

a cooking chamber;

a high frequency heat source;

a hood casing disposed below the cooking chamber, the hood casing including a first intake port through which contaminated air is drawn;

a hood including a second intake port through which contaminated air is drawn, wherein the second intake port vertically aligns and completely overlaps the first intake port to allow the contaminated air to flow therethrough when the hood is inserted into the hood casing;

an elastic member adapted to apply an elastic force of increasing magnitude to the hood as the hood is slidably withdrawn from the hood casing;

a damping member adapted to apply a damping force that opposes the elastic force, thereby reducing a speed at which the hood is withdrawn from the hood casing by the elastic force of the elastic member;

a locking device adapted to prevent the elastic force from unintentionally causing the hood to withdraw from the hood casing; and a vent fan adapted to draw air in through at least one of the first and second intake ports, thereby evacuating contaminated air, wherein the vent fan is configured to draw air through both the first intake port and the second intake port and to cause air to be discharged when the hood is withdrawn from the hood casing.

2. An air evacuation device capable of evacuating contaminated air generated from a cooking device disposed below the air evacuation device, the air evacuation device comprising:

a stationary member disposed above the cooking device and having a first air intake port;

a movable member having a second air intake port, wherein the stationary member is adapted to slidably receive the movable member and wherein the stationary member and the movable member are adapted such that when the movable member is withdrawn from the stationary member, the available air evacuation area is increased;

a locking device preventing unintentional withdrawal of the movable member from the stationary member, wherein the locking device is adapted to engage or disengage in response to an external force applied in a direction toward the stationary member;

a fan adapted to draw contaminated air into the air evacuation system through at least one of the first and second air intake ports; and an elastic member coupled to the moving member, the elastic member adapted to apply an elastic force on the movable member thereby causing the withdraw the movable member to withdraw from the stationary member when the locking device is disengaged.

3. The air evacuation device according to claim 2, further comprising a damping member adapted to apply a damping force that opposes the elastic force, thereby reducing the speed at which the movable member is withdrawn from the stationary member by the elastic force of the elastic member.

4. An air evacuation device capable of evacuating contaminated air generated from a cooking device disposed below the air evacuation device, the air evacuation device comprising:

a stationary member disposed above the cooking device and having a first air intake port;

a movable member having a second air intake port, wherein the stationary member and the movable member are adapted such that the stationary member can slidably receive the moveable member through a front panel and that withdrawing the moveable member from the stationary member increases the available air evacuation area;

a fan adapted to draw contaminated air into the air evacuation system through at least one of the first and second air intake ports;

a first illumination device disposed at the moving member to illuminate the cooking device, the first illumination device being adapted to operate when the moving member is withdrawn from the stationary member and not to operate when the moving member is inserted into the stationary member; and a second illumination device at the stationary member to illuminate the cooking device, the second illumination device being adapted to operate when the moving member is inserted into and withdrawn from the stationary member.

5. The air evacuation device according to claim 4, further comprising:

a pass through opening at the stationary member; wherein the first illumination device corresponds to the size and shape of the pass through opening, and wherein the first illumination device vertically aligns with the pass through opening to pass light generated at the first illumination device through the stationary member and to illuminate the cooking device when the moveable member is inserted in the stationary member.

6. The air evacuation device of claim 4 wherein the first and second illumination devices are adapted to operate regardless whether the moving member is inserted into or withdrawn from the stationary member.

7. The air evacuation device according to claim 2, wherein the locking device comprises:

a latch module at the stationary member, the latch module including a latch slot and a latch hook; and a latch protrusion on the movable member, the latch protrusion adapted to be inserted through the latch slot and selectively engaged with the latch hook.

8. The air evacuation device according to claim 2, wherein the elastic member comprises:

a spring having a front end that is fixed to the movable member; and a spring holder at the stationary member, the spring holder being provided with a rotatable roller around which the spring is wound.

9. The air evacuation device according to claim 2, further comprising at least one rail assembly to guide the sliding movement of the movable member within the stationary member.

10. The microwave oven according to claim 2, further comprising a damping member adapted to apply a damping force that opposes the elastic force, thereby reducing a speed at which the movable member is withdrawn from the stationary member by the elastic force of the elastic member.

11. The air evacuation device according to claim 2, further comprising a guide member to guide contaminated air drawn through the first and second air intake ports.

12. The air evacuation device according to claim 2, wherein the guide member comprises:

a first guide bar in the stationary member; and a second guide bar in the movable member.

13. The microwave oven according to claim 2, further comprising a switch that generates a signal to operate or stop the fan depending on whether the movable member is inserted into or withdrawn from the stationary member.

14. The microwave oven according to claim 13, wherein the switch is adapted to generate a signal to drive the fan when the movable member is being withdrawn from the stationary member, and after the movable member has been withdrawn from the stationary member, the switch is adapted to generate a signal to stop the fan when the movable member is inserted back into the stationary member.

* * * * *